United States Patent [19]

Papalos et al.

[11] Patent Number: 4,514,189

[45] Date of Patent: Apr. 30, 1985

[54] CARBONACEOUS MATERIALS WATER MIXTURES

[75] Inventors: John G. Papalos, Ledgewood; Joseph V. Sinka, Mendham, both of N.J.

[73] Assignee: Diamond Shamrock Chemicals Company, Dallas, Tex.

[21] Appl. No.: 469,168

[22] Filed: Feb. 24, 1983

[51] Int. Cl.[3] ..... C10L 1/32

[52] U.S. Cl. ..... 44/51; 44/76; 260/505 C; 260/505 R; 252/353; 406/49

[58] Field of Search ..... 44/51, 76; 252/353; 406/47, 49, 197; 260/505 R, 505 C

[56] References Cited

U.S. PATENT DOCUMENTS 4,195,975 4/1980 Hamuro et al. ..... 44/51

4,256,871 3/1981 Papalos et al. ..... 528/265

*Primary Examiner*—William R. Dixon, Jr.

*Assistant Examiner*—Margaret B. Medley

*Attorney, Agent, or Firm*—Leslie G. Nunn, Jr.

[57] ABSTRACT

Particulate carbonaceous materials water mixtures are prepared by adding a condensate which is a condensation product of (a) an aldehyde having from about 1 to about 7 carbon atoms, (b) a benzene derivative such as benzene sulfonic acid, an alkyl benzene sulfonic acid having at least one alkyl group of from about 1 to about 20 carbon atoms and mixtures thereof, and optionally, (c) a naphthalene derivative such as naphthalene sulfonic acid, an alkyl naphthalene sulfonic acid having at least one alkyl group of from about 1 to about 12 carbon atoms and mixtures thereof.

The condensate is added in an amount sufficient to reduce viscosity of the water mixture of carbonaceous materials, to stabilize carbonaceous materials in the water network and to improve pumpability. An acid form of the condensate or a salt may be added.

12 Claims, No Drawings

CARBONACEOUS MATERIALS WATER MIXTURES

BACKGROUND OF THE INVENTION

1. Field of the Invention

This invention relates to carbonaceous materials water mixtures and more particularly to coal water mixtures (CWM) stabilized with condensates of benzene derivatives such as benzene sulfonic acid with an aldehyde such as formaldehyde.

2. Description of the Prior Art

Transport is one of the major problems involved in use of particulate carbonaceous materials such as coal. One method of transport involves carbonaceous materials water mixtures. However, water mixtures of finely ground coal containing over 55 weight percent solids are difficult to pump. When the solids level is increased above 50 weight percent, water and solids tend to separate causing build-up of particles in parts of the pumping system. Dewatering of the slurry causes blockage and jamming in the system.

On the other hand, decreasing the weight percent of water in aqueous coal slurries is desirable because water contributes to the cost of transport and processing operations. When less water is transported, a greater volume of coal can be moved, resulting in transport efficiencies. Water resources are also limited. Also, during burning of coal, significant amounts of heat are required to vaporize the water. As the weight percent of water decreases, the efficiency of the coal burning process increases. Hence, use of higher weight percent solids in carbonaceous water mixtures than were heretofore feasible are of great importance.

U.S. Pat. No. 4,282,006—Funk, Aug. 4, 1981, describes a pipeline pumpable coal water slurry having a high content of coal particles with a minimum of void spaces and a maximum of particle surface area to enhance dispersing effects generated by electrolytes and/or dispersing agents added to the slurry. For dispersing agents, see column 29, line 53 to colum 31, line 9, including condensed mononaphthalene sulfonic acid and its sodium and ammonium salts (column 30, lines 19 and 20).

U.S. Pat. No. 4,330,301—Yamamura et al, May 18, 1982, describes dispersants for aqueous coal slurries including sodium and ammonium salts of condensation products of naphthalene sulfonic acid and formaldehyde condensates. See column 2, lines 41 to 43 and columns 5 and 6.

SUMMARY OF THE INVENTION

Particulate carbonaceous materials water mixtures having reduced viscosity, a stabilized network of carbonaceous materials in water and improved pumpability are obtained by having present a condensate and salts thereof of a condensation product of (a) an aldehyde having from about 1 to about 7 carbon atoms such as formaldehyde, (b) a benzene derivative such as benzene sulfonic acid, an alkyl benzene sulfonic acid having at least one alkyl group of from about 1 to about 20 carbon atoms and mixtures thereof, and optionally (c) a naphthalene derivative such as naphthalene sulfonic acid, an alkyl naphthalene sulfonic acid having at least one alkyl group of from about 1 to about 12 carbon atoms and mixtures thereof, the condensate being present in an amount sufficient to reduce viscosity of the water slurry of carbonaceous materials, to stabilize carbonaceous materials in the water network and to improve its pumpability. If desired, an acid form or salt of the condensate may be used.

DETAILED DESCRIPTION

The condensate of a benzene derivative and optionally a naphthalene derivative with an aldehyde having from about 1 to about 7 carbon atoms such as formaldehyde, hereinafter referred to as condensate for convenience, is present in the carbonaceous materials water mixture in amounts sufficient to reduce viscosity of the mixture and improve its pumpability. Concentration of the condensate added, based on the total weight of the carbonaceous materials water mixture, can be up to 10% by weight, preferably from about 0.01% by weight to about 5.0% by weight. For example, from about 0.05% by weight to about 0.5% by weight of the condensate, based on the total weight of the mixture, i.e., solids plus water, can be used. Amount of the condensate required is easily determined by introducing the condensate in an amount sufficient to form a soft sediment. The resulting mixtures will generally have from about 50% to about 80% by weight or higher solids with the balance being water.

The term "carbonaceous materials", as used herein, encompasses solid particulate carbonaceous fossil fuel materials which may have been powdered or pulverized to a size where at least 80% will pass through a 200 mesh screen (U.S. Series). Useful carbonaceous materials include bituminous and anthracite coals, coke, petroleum, coke, lignite, charcoal, peat, admixtures thereof and the like.

Water used in carbonaceous materials water mixtures may be taken from any available source such as mine, well, river, or lake water or desalinated ocean water having a suffficiently low mineral salt content such that the electrochemistry of the bound water layer and carrier water interface can be controlled so that corrosion of milling facilities, pipelines and furnaces will be minimized or inhibited.

Condensates useful as CWM dispersants are condensation products of benzene derivatives such as benzene sulfonic acid with an aldehyde such as formaldehyde or condensation products of a benzene derivative such as benzene sulfonic acid and a naphthalene derivative such as naphthalene sulfonic acid with an aldehyde such as formaldehyde.

Benzene derivatives include benzene sulfonic acid, alkyl benzene sulfonic acids having at least one alkyl group of from about 1 to about 20 carbon atoms and their mixtures with the preferred alkyl benzene sulfonic acids having one or two alkyl groups. Specific benzene derivatives include benzene sulfonic acid, toluene sulfonic acid, ethyl benzene sulfonic acid, propyl benzene sulfonic acid, hexyl benzene sulfonic acid, octyl benzene sulfonic acid, dodecyl benzene sulfonic acid, octadecyl benzene sulfonic acid, eicosyl benzene sulfonic acid, their isomers, mixtures and the like. The alkyl group may be linear or branched. Alkyl benzenes are well known in the art and may be pepared by the Friedel-Crafts reaction of benzene with the appropriate alkyl chloride. Benzene and alkyl benzenes may be sulfonated with a sulfonating agent such as sulfuric acid, sulfur trioxide or the like.

Naphthalene derivatives include naphthalene sulfonic acid, alkyl naphthalene sulfonic acid having at least one alkyl group of from about 1 to about 12 carbon atoms and their mixtures with the preferred alkyl benzene sulfonic acid having a single alkyl group. Specific alkyl naphthalene derivatives include naphthalene sulfonic acid, methyl naphthalene sulfonic acid, ethyl naphthalene sulfonic acid, propyl naphthalene sulfonic acid, butyl naphthalene sulfonic acid, hexyl naphthalene sulfonic acid, octyl naphthalene sulfonic acid, dodecyl naphthalene sulfonic acid, their isomers, mixtures and the like. The alkyl group may be linear or branched. Alkyl naphthalenes are well known in the art and may be prepared by alkylation of naphthalene with alcohols or olefins using a sulfuric acid catalyst. Naphthalene and alkyl naphthalenes may be sulfonated with sulfuric acid, sulfur trioxide or the like.

Aldehydes such as aldehydes or aldehyde compositions which provide aldehydes containing from 1 to 7 carbon atoms can be used in the condensation. For example, formaldehyde can be used in the form of 30 to 40% aqueous solutions, 30 to 55% alcohol solutions with alcohols such as methanol, n-butanol, i-butanol or the like. Formaldehyde can also be used in any of its polymeric forms such as paraformaldehyde, trioxane, hexamethylene tetramine or the like. Other aldehydes such as acetaldehyde, butyraldehyde, heptaldehyde, furfuraldehyde, chloral, alpha-ethyl—betapropylacrolein, benzaldehyde or the like can be substituted for formaldehyde in the condensation. Aldehyde compositions such as acetals which liberate such aldehydes can also be employed.

Condensates of mixtures of the benzene derivatives and mixtures of the benzene derivatives and naphthalene derivatives may be prepared by condensing these mixtures with an aldehyde. If desired, the condensate may be neutralized with a base such as sodium hydroxide, potassium hydroxide, lithium hydroxide, calcium hydroxide, magnesium hydroxide, zinc carbonate, ammonium hydroxide, an amine such as methylamine, diethyl amine, triethanolamine or the like.

Condensates of a benzene derivative such as benzene sulfonic acid, alkyl benzene sulfonic acid or their mixtures and optionally a naphthalene derivative such as naphthalene sulfonic acid, alkyl naphthalene sulfonic acid or their mixtures may be prepared by condensing one mole of the benzene derivative and optionally the naphthalene derivative with from about 0.2 to about 3.0 moles of an aldehyde having from about 1 to about 7 carbon atoms at about 70° to about 150° C. with the preferred being from about 0.3 to about 2 moles of an aldehyde at about 90° to about 150° C. The condensation may also be carried out stepwise: first, by condensing the benzene derivative with an aldehyde to obtain a condensate of the benzene derivative with aldehyde and then second, by condensing the condensate of the benzene derivative with naphthalene and an aldehyde.

This process may be used to prepare condensates of aldehydes such as formaldehyde, a benzene derivative such as benzene sulfonic acid, an alkyl benzene sulfonic acid having an alkyl group of from about 1 to about 3 carbon atoms and their mixtures, and optionally a naphthalene derivative such as naphthalene sulfonic acid, an alkyl naphthalene sulfonic acid having an alkyl group of from about 1 to about 3 carbon atoms and their mixtures.

Preparation of condensates of naphthalene sulfonic acid and alkyl benzene sulfonic acids having an alkyl group of from about 4 to about 20 carbon atoms are described in U.S. Pat. No. 4,256,871—Papalos and Kavchok, issued Mar. 17, 1981. The teachings of this patent relating to the preparation of these condensates are incorporated by reference herein.

For a fuller understanding of the nature and advantages of this invention, reference may be made to the following examples. These examples are given merely to illustrate the invention and are not to be construed in a limiting sense. All quantities, proportions and percentages are by weight and all references to temperature are °C. unless otherwise indicated.

EXAMPLE I

Condensate of Xylene Sulfonic Acid with Formaldehyde and Neutralized with Ammonium Hydroxide

A. Sulfonation

In a one-liter four-necked reaction flask equipped with agitator, thermometer, reflux condenser and heating mantle, there was charged 106 grams (one mole) of xylene. Then 150 grams of $H_2SO_4$ (20% $SO_3$, 1.5 moles, molecular weight 100) was added at 20°-40° C., over a period of two hours, while maintaining the temperature via external cooling. At the end of the acid addition, the reaction was heated at 90°-95° C. for 2.25 hours. Then it was cooled to room temperature and 138 grams of water was added to 30°-40° C. The resulting sulfonation mixture contained 65% xylene sulfonic acid.

B. Polymerization

In a similar reactor as described in Part A, there was charged 200 grams (0.508 mole) of the sulfonation product from Part A. There was added 24.4 grams of 37% formaldehyde (0.304 mole) at 60° C. The reaction mixture was then heated to reflux (110° C.) until all of the formaldehyde was reacted, as determined by standard sodium sulfite titration procedure. The resulting product was a condensate of xylene sulfonic acid with formaldehyde.

The above procedure was also used to prepare condensation products of xylene sulfonic acid with formaldehyde containing 0.5, 0.6, 0.7 and 0.9 moles of formaldehyde per mole of sulfonated monomers.

C. Neutralization with Ammonium Hydroxide 100 grams of Part B condensate was diluted with 64.0 grams of water. An acid value of 184.4 was measured using phenolphthalein as the indicator. Based on this acid value, 133.0 grams of the acid condensate was neutralized with 33.0 grams of ammonium hydroxide. The resulting product was a 35% ammonium salt of the condensate of xylene sulfonic acid with formaldehyde having a pH of 7.5 (10% solution).

EXAMPLE II

Condensate of Xylene Sulfonic Acid and Naphthalene Sulfonic Acid with Formaldehyde and Neutralized with Ammonium Hydroxide In a similar reactor as described in Example 1, there was charged 100 grams of the xylene sulfonation product of Example IA (0.113 mole). Then 27 grams of naphthalene sulfonic acid (0.113 mole) was added while controlling the exotherm at 60°-70° C. Next 9.1 grams of 37% formaldehyde (0.112 mole) and 7.0 grams of water were added and the reaction mixture heated to reflux (110° C.) and refluxed until all the formaldehyde was reacted, as determined by sodium sulfite titration procedure. Then 110 grams of water was added at 80°-90° C. and the reaction mixture cooled to room temperature. An acid value of 140 was measured using phenolphthalein as the indicator. Based on this acid value, 100 grams of the condensation product of the mixture of xylene sulfonic acid and naphthalene sulfonic acid with formaldehyde was neutralized with 15.2 grams of ammonium hydroxide (28%). The resulting product was a 34% ammonium salt of the condensation product having a pH of 7.3 (10% solution).

The procedure in Example II was used to prepare condensates of mixtures of xylene sulfonic acid and naphthalene sulfonic acid with formaldehyde containing 0.5, 0.6, 0.7, 0.8 and 1.0 moles of formaldehyde per mole of mixed sulfonation monomers. These formaldehyde ratios were repeated with mixed sulfonation monomers containing one mole and two moles of xylene sulfonic acid per mole of naphthalene sulfonic acid.

EXAMPLE III

Condensate of Dodecylbenzene Sulfonic Acid and Xylene Sulfonic Acid with Formaldehyde and Neutralized with Ammonium Hydroxide In a similar reactor as described in Example 1A, there was charged 50 grams (0.140 mole) of dodecylbenzene sulfonic acid, 121.5 grams of sulfonation product from Example IA, (0.308 mole), 23.7 grams of 37% formaldehyde (0.293 mole) and 25 grams of water. The reaction mixture was then heated to reflux (110° C.) until 97% of the formaldehyde was reacted as determined by the sodium sulfite titration method. Then 160 grams of water was added at 80°-90° C. and the reaction mixture was cooled to room temperature. An acid value of 134.4 was measured using phenolphthalein as the indicator. Based on this acid value, 375 grams of the free acid reaction mixture was neutralized with 64 grams of ammonium hydroxide (28%). The final product was 31% ammonium salt of the condensate of a mixture of dodecylbenzene sulfonic acid and xylene sulfonic acid with formaldehyde having a pH of 7.8 (10% solution).

EXAMPLE IV

Condensate of Dodecylbenzene Sulfonic Acid and Naphthalene Sulfonic Acid with Formaldehyde and Neutralized with Sodium Hydroxide In a similar reactor as described in Example IA, there was charged 128 grams of dodecylbenzene sulfonic acid (0.36 mole, molecular weight 355.5), 86.0 grams naphthalene sulfonic acid (0.36 mole), 35.2 grams of 37% formaldehyde (0.432 mole) and 79.0 grams of water. The reaction mixture was heated to reflux for twenty-two hours when all of the formaldehyde was reacted as determined by the sodium sulfite titration procedure. Then 147 grams of water was added under reflux and the free acid reaction mixture was cooled to room temperature. An acid value of 128.8 was measured using phenolphthalein as the indicator. Based on this acid value, 50 grams of the free acid of the condensation product was neutralized with 9.2 grams of 50% sodium hydroxide at 30°-40° C. An additional 20 grams of water was added to yield a 32% sodium salt of the condensation product of a mixture of dodecylbenzene sulfonic acid and naphthalene sulfonic acid with formaldehyde having a pH of 7.6 (10% solution).

EXAMPLE V

Evaluation of Dispersants for Coal Water Slurries

The following procedure was used in evaluation of the condensates in aqueous coal slurries (CWM). This procedure determines ability of the condensates to disperse or suspend coal dust uniformly in water by measuring viscosity and examining any sediment, if formed.

| | |
|---|---|
| SCOPE | Evaluation of dispersants for coal in aqueous slurries and their efficacy to disperse or suspend coal dust uniformly in water. |
| PRINCIPLE | Transport problems are one of the major difficulties in the use of coal. Aqueous slurries of finely ground coal containing more than about 55 weight percent solids are difficult to transport using conventional slurry pumps, because when the solids level is increased above 50 wt. %, water and solids tend to separate causing coal particles to build up in parts of the pumping system. It has been shown that addition of small amounts of dispersant and/or certain water soluble polymers to aqueous coal slurries permit the transport of coal slurries with much higher wt. % solids content than were heretofore possible. |
| APPARATUS | 1. 8-oz. paint can.<br>2. Low shear mechanical mixer with a double blade.<br>3. Spatula.<br>4. Stormer viscometer. |
| REAGENTS | 1. Water (record hardness).<br>2. Coal dust - Reference coal is Pittston Coal, 80% thru 200 mesh. Other types of coal and grind sizes can be substituted.<br>3. Dispersants (condensates). |

PROCEDURE

A 1000 gram sample of a 60/40 coal/water slurry was prepared by adding coal slowly to the water with agitation using a low shear mechanical mixer with a double blade. Sides of the container were scraped to insure uniformity of the slurry while mixing. After all the coal was added, the slurry was then stirred an additional 30 minutes.

1. 200 grams of 60/40 coal/water slurry was placed in an 8 oz. paint can and was set aside as the Blank (CWM without dispersant). This procedure was repeated with the exception that to each new sample was added predetermined amounts of dispersant based on the weight of coal (concentration from 0.1 to 0.7, Table I).

2. All containers were closed tightly to prevent evaporation of the water.

3. Each container was opened and the slurry was stirred with a spatula before viscosity measurement using the Stormer viscometer. The weights were adjusted so that a reading was obtained for a 30 second viscosity. After obtaining the correct weight for a 30 second viscosity, the reading was repeated twice. The average of the two reading was then recorded as the viscosity of each CWM in seconds.

4. The procedure in Step 3 was repeated with slurries of each dispersant until the dispersant no longer reduced the viscosity of the slurry.

5. The time in seconds was converted into Krebs Units and Krebs Units to Centipoise (cps) readings.

6. Table I shows the results of this procedure.

TABLE I

The procedure in Example V was used to measure the viscosity (cps) of the following 60/40 Pittston/water slurries containing various dispersants.

| Dispersant of Example | % Concentration of Dispersant 0.1 | 0.2 | 0.3 | 0.5 | 0.7 |
|---|---|---|---|---|---|
| I | 790 | 410 | 330 | 300 | 300 |
| II | 390 | 290 | 260 | 250 | 250 |
| III | 1100 | 620 | 470 | 240 | 240 |
| IV | 910 | 800 | 700 | 710 | — |

Blank (no dispersant) 3,100 cps.

Example No. V was repeated to measure the dispersing properties of various dispersants in Table II.

TABLE II

60/40 Pittston Coal/Water Slurry

| Dispersant of Example | Mole Ratio XSA/NSA | $CH_2O/RSO_3H$* | % of Dispersant 0.1 | 0.3 | 0.5 | 0.7 |
|---|---|---|---|---|---|---|
| II | 1 | 0.5 | 250 | 170 | 170 | — |
| II | 1 | 0.9 | 190 | 170 | 170 | — |
| II | 2 | 0.5 | 190 | 170 | 170 | — |
| II | 2 | 0.9 | 360 | 230 | 170 | 170 |

Blank (no dispersant) 1,550 cps.

*$CH_2O$ mole ratio is based on the sum of the moles of the sulfonated monomers xylene

EXAMPLE VI

Condensate of Toluene Sulfonic Acid with Formaldehyde and Neutralized with Potassium Hydroxide

A. Sulfonation

In a similar reactor as described in Example IA, there was charged 92 grams of toluene (1.0 mole), then 150 grams of $H_2SO_4$ (20% $SO_3$) was added at 20°-40° C. Then the reaction mixture was heated at 90°-95° C. for 2.25 hours. It was then cooled to room temperature. Then 130 grams of water was added at 20°-40° C. The resulting product contained 65% toluene sulfonic acid.

B. Polymerization

In an identical reactor as described in Example IA, there was charged 200 grams of sulfonation product of Example VI Part A (0.5376 mole) and 21.8 grams of 37% formaldehyde (0.269 mole). The reaction mixture was heated to reflux until all of the formaldehyde reacted as measured via the sodium sulfite titration procedure. The resulting product was a 60% acid condensate of toluene sulfonic acid with formaldehyde.

C. Neutralization with Potassium Hydroxide

The acid condensate from Example VI Part B (221.8 grams) was diluted with 160 grams of water. An acid value of 179.2 was measured using phenolphthalein as the indicator. Based on this acid value, 154 grams of the acid condensate was neutralized with 35 grams of 45% KOH. The resulting product was 32.6% potassium salt of the condensate having a pH of 7.8 (10% solution).

EXAMPLE VII

Condensate of Toluene Sulfonic Acid and Naphthalene Sulfonic Acid with Formaldehyde and Neutralized with Ammonium Hydroxide In a similar reactor as described in Example IA, there was charged 50 grams (0.061 mole) of the free acid of Example VIB condensate, 14.5 of naphthalene sulfonic acid (0.061 mole), 6.5 grams of water and 4.9 grams of 37% formaldehyde (0.061 mole). The reaction mixture was then heated to reflux (110° C.) until all formaldehyde was reacted. Then 53.5 grams of water was added at 80°-90° C. and the reaction product, the acid condensate of toluene sulfonic acid and naphthalene sulfonic acid with formaldehyde, was cooled to room temperature. An acid value of 156.8 was measured using phenolphthalein as the indicator. Based on this acid value, 12.0 grams of the acid reaction product was neutralized with 25 grams of ammonium hydroxide (28%). The resulting product contained 32.5% solids and had a pH of 7.7 (10% solution).

EXAMPLE VIII

Condensate of Isopropylnaphthalene Sulfonic Acid and Xylene Sulfonic Acid with Formaldehyde and Neutralized with Ammonium Hydroxide

A. Preparation of Isopropylnaphthalene Sulfonic Acid

In a similar reactor as described in Example IA, there was charged 25 grams (0.15 mole) of isopropanol, then 64 grams of naphthalene (0.5 mole) was added at 30° to 70° C. and stirred to dissolve the naphthalene. Next, 50 grams of sulfuric acid (98%) was added at 70°-80° C. over a period of 30 minutes. After the exothermic reaction stopped, the reaction mixture was heated at 75°-80° C. for one hour. Then it was cooled to 30° C. and 150 grams of $H_2SO_4$ (20% $SO_3$) was added at 30°-40° C. over a period of one hour. The reaction mixture was stirred for three hours at 50°-55° C. Tis was then cooled to 30° C. and 156 grams of water was added at 30°-40° C. The reaction product contained 65% isopropylnaphthalene sulfonic acid.

B. Condenssate of Isopropylnaphthalene Sulfonic Acid and Xylene Sulfonic Acid with Formaldehyde and Neutralized with Ammonium Hydroxide In a similar reactor as described in Example IA, there was charged 50.0 grams (0.057 mole) of sulfonation product of Example IB, 25.4 grams (0.0285 mole) of Example VIIIA and 3.5 grams (0.0432 mole) of 37% formaldehyde. The eaction mixture was heated to reflux until all formaldehyde was reacted to obtain the acid condensate of isopropylnaphthalene sulfonic acid and xylene sulfonic acid with formaldehyde. Then 55.0 grams of water was added at 80°-90° C. and the reaction mixture cooled to room temperature. An acid value of 201.6 was measured using phenolphthalein as the indicator. Based on this acid value, 124 grams of the acid condensate was neutralized with 28 grams of ammonium hydroxide. The resulting product was a 34% ammonium salt of the condensate of isopropylnaphthalene sulfonic acid and xylene sulfonic acid with formaldehyde having a pH of 7.5 (10% solution).

EXAMPLE IX

Condensate of Benzene Sulfonic Acid and Naphthalene Sulfonic Acid with Formaldehyde and Neutralized with Ammonium Hydroxide In a similar reactor as described in Example IA, there was charged 50 grams of naphthalene sulfonic acid (0.210 mole), 16.6 grams of benzene sulfonic acid (0.105 mole), 12.7 grams of 37% formaldehyde (0.1575 mole) and 36.0 grams of water. The reaction mixture was then heated to reflux (110° C.) until all of the formaldehyde reacted as determined by the $Na_2SO_3$ titration procedure. Then 81.0 grams of water was added and the reaction cooled to room temperature. An acid value of 105.3 was measured using phenolphthalein as the indicator. Based on this acid value, 174 grams of acid was neutralized with 24 grams of ammonium hydroxide. The final product was 32% solids of the ammoniuum salt of the condensate of benzene sulfonic acid and naphthalene sulfonic acid with formaldehyde having a pH of 7.0 (10% solution).

EXAMPLE X

Condensate of Propylbenzene Sulfonic Acid with Formaldehyde and Neutralized with Ammoniuum Hydroxide

A. Sulfonation of Propylbenzene

In a similar reactor as described in Example IA, there was charged 50 grams (0.416 mole) of propylbenzene. Then 62.4 grams of fuming sulfuric acid (20% $SO_3$) was added at 20°–40° C. over a two hour period. The reaction mixture was then heated at 95°–100° C. for two hours. Next, 60 grams of water was added at 80°–90° C. and the reaction mixture cooled to room temperature. The resulting product contained 65% propylbenzene sulfonic acid.

B. Condensation and Neutralization with Ammonium Hydroxide

In a similar reactor as described in Example IA, there was charged 50 grams (0.121 mole) of sulfonation product of Example XA and 4.9 grams 37% formaldehyde (0.060 mole). The reaction was then heated to reflux (110° C.) for thirty hours. An acid value of 166 was measured using phenolphthalein as the indicator. Based on this acid value, 67 grams of the condensation product was neutralized with 17 grams of ammonium hydroxide. The resulting product was 33.2% ammonium salt of the condensate of propylbenzene sulfonic acid with formaldehyde having a pH of 7.2 (10% solution).

EXAMPLE XI

Example V was repeated to measure the dispersing properties of various dispersants listed in Table III.

TABLE III

| Dispersant of Example | Mole Ratio $CH_2O/RSO_3H$ | % Dispersant 0.1 | 0.2 | 0.5 | 0.75 | 1.0 |
|---|---|---|---|---|---|---|
| 60/40 Pittston Coal Water Slurry | | | | | | |
| A. Without Stabilizer (Guar Gum) | | | | | | |
| VII | 0.5 | 733 | 480 | 330 | 280 | 250 |
| IX | 0.5 | 1067 | 667 | 330 | 330 | — |
| VIII | 0.5 | 1100 | 767 | 385 | 300 | 280 |
| IX | 0.5 | 385 | 360 | 280 | 250 | 240 |
| VII | 0.9 | 575 | 330 | 460 | 435 | 435 |
| VII | 1.2 | 633 | 480 | 280 | 280 | — |
| X | 0.5 | 2300 | 1600 | 1200 | 1000 | 900 |

TABLE III-continued

| Dispersant of Example | Mole Ratio $CH_2O/RSO_3H$ | % Dispersant 0.1 | 0.2 | 0.5 | 0.75 | 1.0 |
|---|---|---|---|---|---|---|
| 60/40 Pittston Coal Water Slurry | | | | | | |
| Blank (no dispersant) 2,540 cps. | | | | | | |
| B. With Stabilizer (0.02% Guar Gum) | | | | | | |
| VII | 0.5 | 825 | 800 | 1200 | 1100 | 1150 |
| VIII | 0.5 | 975 | 733 | 435 | 360 | 385 |
| IX | 0.5 | 600 | 1150 | 1125 | 1000 | 900 |
| Blank (no dispersant) 2,480 cps. | | | | | | |

EXAMPLE XII

Example V was repeated to measure the initial viscosity and twenty-four hours slurry stability of various dispersants shown in Table IV.

TABLE IV

| Example | Mole Ratio XSA/NSA | Mole Ratio $CH_2O/RSO_3H$ | % Concentration of Dispersant | Initial Viscosity | 24 Hours % Sediment |
|---|---|---|---|---|---|
| 60/40 Pittston Coal/Water Slurry With 0.021 Karaya Gum | | | | | |
| II | 1 | 0.9 | 0.1 | 450 | 0 |
| II | 1 | 0.9 | 0.2 | 420 | 2 |
| II | 1 | 0.9 | 0.3 | 35 | 2 |
| II | 2 | 0.9 | 0.1 | 1065 | 0 |
| II | 2 | 0.9 | 0.2 | 630 | 30 Soft |
| II | 2 | 0.9 | 0.3 | 330 | 40 Soft |
| I | — | 0.9 | 0.1 | 1200 | 0 |
| I | — | 0.9 | 0.2 | 100 | 0 |
| I | — | 0.9 | 0.3 | 660 | 0 |
| Blank (no dispersant) 3,500 cps. | | | | | |

EXAMPLE XIII

Condensation Product of Xylene Sulfonic Acid with Butyraldehyde and Neutralized with Ammonium Hydroxide In a similar reactor as described in Example IA, there was charged 200 grams (0.508 mole) of sulfonation product of Example IA, 21.96 grams (0.305 mole) of butyraldehyde and 31 grams of water. The reaction mixture was then heated to reflux for 24 hours. It was then cooled to room temperature and an acid value of 145.6 was determined using phenolphthalein as the indicator. Based on this acid value, 180.0 grams of the sulfonation product was neutralized with 29.0 grams (28%) as ammonium hydroxide to pH 7.2 (10% solution). The final product was a 30% ammonium salt of xylene sulfonic acid butyraldehyde condensate.

EXAMPLE XIV

Example V was repeated to measure the initial viscosity of the slurry when the condensation product of Example XIII was used as dispersant in Table V.

TABLE V

| Dispersant of Example | % Concentration of Dispersant 0.1 | 0.2 | 0.5 | 0.75 | 1.0 |
|---|---|---|---|---|---|
| 60/40 Pittston Coal/Water Slurry | | | | | |
| XIII | 2,000 | 1,850 | 1,233 | 1,175 | 1,000 |
| Blank (no dispersant) 2,571 cps. | | | | | |

While the invention has been described with reference to certain specific embodiments thereof, it is understood that it is not to be so limited since alterations and changes may be made therein which are within the full intended scope of the appended claims.

What is claimed is:

1. A water slurry of solid particulate carbonaceous materials having present a condensate which is a condensation product of (a) an aldehyde having from about 1 to about 7 carbon atoms, (b) a benzene derivative selected from the group consisting of benzene sulfonic acid, an alkyl benzene sulfonic acid having at least one alkyl group of from about 1 to about 20 carbon atoms and mixtures thereof, and optionally (c) a naphthalene derivative selected from the group consisting of naphthalene sulfonic acid, an alkyl naphthalene sulfonic acid having at least one alkyl group of from about 1 to about 12 carbon atoms and mixtures thereof, the condensate being present in an amount sufficient to reduce viscosity of the water slurry, to stabilize carbonaceous materials in the water network, to form a soft sediment and to improve pumpability of the water slurry.

2. The water slurry of claim 1 wherein the aldehyde is formaldehyde.

3. The water slurry of claim 2 wherein from about 0.2 to about 3.0 moles of formaldehyde is condensed with one mole of benzene derivative in the condensate.

4. The water slurry of claim 2 wherein from about 0.3 to about 2.0 moles of formaldehyde is condensed with one mole of a mixture of benzene derivative and naphthalene derivative.

5. The water slurry of claim 4 wherein the weight ratio of benzene derivative to naphthalene derivative is from about 95:5 to 5:95 parts by weight.

6. The water slurry of claim 2 wherein the benzene derivative is xylene sulfonic acid and the naphthalene derivative is naphthalene sulfonic acid.

7. The water slurry of claim 2 wherein the benzene derivative is a mixture of ortho xylene sulfonic acid and para xylene sulfonic acid.

8. The water slurry of claim 2 wherein the benzene derivative is toluene sulfonic acid and the naphthalene derivative is methyl naphthalene sulfonic acid.

9. The water slurry of claim 2 wherein the benzene derivative is xylene sulfonic acid and the naphthalene derivative is naphthalene sulfonic acid.

10. The water slurry of claim 2 wherein the benzene derivative is xylene sulfonic acid and the naphthalene derivative is methyl naphthalene sulfonic acid.

11. The water slurry of claim 2 wherein the benzene derivative is xylene sulfonic acid and the naphthalene derivative is isopropyl naphthalene sulfonic acid.

12. The water slurry of claim 2 wherein the benzene derivative is toluene sulfonic acid and the naphthalene derivative is isopropyl naphthalene sulfonic acid.

* * * * *